US006460723B2

(12) United States Patent
Nguyen et al.

(10) Patent No.: US 6,460,723 B2
(45) Date of Patent: Oct. 8, 2002

(54) METALLIC BEVERAGE CAN END

(75) Inventors: Tuan A. Nguyen, Golden; Jess N. Bathurst, Fort Collins, both of CO (US)

(73) Assignee: Ball Corporation, Brommfield, CO (US)

( * ) Notice: Subject to any disclaimer, the term of this patent is extended or adjusted under 35 U.S.C. 154(b) by 0 days.

(21) Appl. No.: 09/860,740

(22) Filed: May 18, 2001

(65) Prior Publication Data

US 2002/0134788 A1 Sep. 26, 2002

Related U.S. Application Data

(60) Provisional application No. 60/264,568, filed on Jan. 26, 2001, and provisional application No. 60/262,829, filed on Jan. 19, 2001.

(51) Int. Cl.[7] ..... B05D 6/28

(52) U.S. Cl. ..... 220/619; 220/623; 220/624

(58) Field of Search ..... 220/619, 615, 220/621, 623, 624

(56) References Cited

U.S. PATENT DOCUMENTS

| | | | | |
|---|---|---|---|---|
| 2,894,844 A | | 7/1959 | Shakman | 99/182 |
| 3,176,872 A | | 4/1965 | Zundel | 220/54 |
| 3,251,515 A | | 5/1966 | Henchert et al. | 222/487 |
| 3,268,105 A | | 8/1966 | Geiger | 220/49 |
| D206,500 S | | 12/1966 | Nissen et al. | D58/26 |
| 3,480,175 A | | 11/1969 | Khoury | 220/54 |
| 3,734,338 A | | 5/1973 | Schubert | 220/54 |
| 3,744,667 A | | 7/1973 | Fraze et al. | 220/48 |
| D229,396 S | | 11/1973 | Zundel | D9/99 |
| 3,774,801 A | | 11/1973 | Gedde | 220/66 |
| 3,836,038 A | | 9/1974 | Cudzik | 220/48 |
| 3,843,014 A | | 10/1974 | Cospen et al. | 220/66 |
| 3,982,657 A | | 9/1976 | Keller et al. | 220/268 |
| 4,015,744 A | | 4/1977 | Brown | 220/269 |
| 4,030,631 A | | 6/1977 | Brown | 220/269 |
| 4,127,212 A | | 11/1978 | Waterbury | 220/254 |
| 4,402,419 A | | 9/1983 | MacPherson | 220/70 |
| 4,467,933 A | | 8/1984 | Wilkinson et al. | 220/66 |
| D279,265 S | | 6/1985 | Turner et al. | D9/438 |
| D281,581 S | | 12/1985 | MacEwen | D9/435 |
| 4,606,472 A | * | 8/1986 | Taube et al. | 220/610 |
| 4,713,958 A | * | 12/1987 | Bulgo, Jr. et al. | |
| 4,735,863 A | | 4/1988 | Bachmann et al. | 428/579 |
| 4,809,861 A | | 3/1989 | Wilkinson et al. | 220/66 |
| D300,607 S | | 4/1989 | Ball | D9/438 |
| D304,302 S | | 10/1989 | Dalli et al. | D9/438 |
| 4,991,735 A | * | 2/1991 | Biondich | 220/600 |
| 5,046,637 A | * | 9/1991 | Kysh | 220/610 |
| 5,145,086 A | | 9/1992 | Krause | 220/270 |
| D337,521 S | | 7/1993 | McNulty | D9/438 |
| 5,356,256 A | * | 10/1994 | Turner et al. | |
| D356,498 S | | 3/1995 | Strawser | D9/435 |
| 5,685,189 A | | 11/1997 | Nguyen et al. | 72/348 |
| D406,236 S | | 3/1999 | Brifcani et al. | D9/438 |
| 5,950,858 A | | 9/1999 | Sergeant | 220/269 |
| 6,065,634 A | | 5/2000 | Brifcani et al. | 220/619 |
| 6,102,243 A | | 8/2000 | Fields et al. | 220/619 |

FOREIGN PATENT DOCUMENTS

| | | |
|---|---|---|
| WO | WO 98/34743 | 8/1998 |

* cited by examiner

*Primary Examiner*—Joseph M. Moy
(74) *Attorney, Agent, or Firm*—Sheridan Ross P.C.

(57) ABSTRACT

The present invention describes a beverage can end which utilizes less material and has an improved internal buckle strength based on the geometric configuration of an upper and lower chuck wall, inner panel wall and central panel, and having a unit depth to an outwardly concave countersink of at least about 0.215 inches.

25 Claims, 17 Drawing Sheets

PRIOR ART 202 SHELL

PRIOR ART 202 PRESHELL

METALLIC BEVERAGE CAN END

This application claims priority of U.S. provisional patent application Ser. No. 60/264,568, entitled "Beverage Can End With Improved Countersink" having a filing date of Jan. 26, 2001, and U.S. provisional application Ser. No. 60/262,829 entitled "Beverage Can End With Reduced Countersink", having a filing date of Jan. 19, 2001, both applications being incorporated herein in their entirety by reference.

FIELD OF THE INVENTION

The present invention generally relates to beverage can ends, and more specifically metallic beverage can ends used for interconnection to a beverage can body.

BACKGROUND OF THE INVENTION

Beverage containers and more specifically metallic beverage cans are typically manufactured by interconnecting a beverage can end on a beverage container body. In some applications, two ends may be interconnected on a top side and a bottom side of a can body. More frequently, however, a beverage can end is interconnected on a top end of a beverage can body which is drawn and pressed from a flat sheet of blank material such as aluminum. Due to the potentially high internal pressures generated by carbonated beverages, both the beverage can body and the beverage can end are typically required to sustain internal pressures exceeding 90 psi without catastrophic and permanent deformation. Further, depending on various environmental conditions such as heat, over fill, high CO2 content, and vibration, the internal pressure in a beverage can may exceed internal pressures approaching 100 psi.

Thus, beverage can ends must be durable to withstand high internal pressures, yet manufactured with extremely thin materials such as aluminum to decrease the overall cost of the manufacturing process and weight of the finished product. Accordingly, there exists a significant need for a durable beverage can end which can withstand the high internal pressures created by carbonated beverages, and the external forces applied during shipping, yet which is made from durable, lightweight and extremely thin metallic materials. The following patent application describes an improved beverage can end which is adapted for interconnection to a beverage can body and which has an improved countersink, central panel area and unit depth which significantly saves material costs, yet can withstand significant internal pressures.

SUMMARY OF THE INVENTION

Thus, in one aspect of the present invention, a beverage can end is provided which can withstand significant internal pressures approaching 100 psi and yet saves between 3% and 15% of the material costs associated with manufacturing a typical beverage can end.

In another aspect of the present invention, a beverage can end is provided which is manufactured with conventional manufacturing equipment and thus eliminates the need for expensive new punches and presses required to make the beverage can end. Thus, existing and well known manufacturing equipment and processes can be implemented to quickly and effectively initiate the production of an improved beverage can end in an existing manufacturing facility.

In another aspect of the present invention, a method for forming a beverage can end is provided, and which results in a can end with a countersink radius of no greater than 0.015 inches. More specifically, the method for manufacturing generally comprises a two-step process, wherein a conventional can end "pre-shell" is first formed and then captured between two opposing tools, where a clamping function is then performed prior to placing the beverage can countersink in compression. The reforming tool positioned on the underside of the shell contains the desired panel diameter, panel radius, wall type, and outer preferred geometric dimensions as necessary. The pre-shell is then pushed into the reforming tool, which forces the countersink area against the panel tool and rolling up the panel, thus taking the panel tool shape and wrapping the lower radius tight against the panel tool. Preferably, the reforming of the pre-shell is accomplished without using a punch directed downward into the countersink area.

It is another aspect of the present invention to provide a beverage can end which saves material costs by reducing the size of the blank material as opposed to utilizing thinner materials which are susceptible to failure. Thus, the integrity and strength of the beverage can end is not compromised, while material costs are significantly reduced as a result of the blank reduction.

It is a further object of the present invention to provide a beverage can end which utilizes reduced thickness metallic materials to save additional costs, yet provide sufficient strength based on the aluminum alloy properties provided therein.

It is a further aspect of the present invention to provide a beverage can end with an upper chuck wall oriented at a first chuck wall angle $\theta_1$ and a lower chuck wall oriented at a lower chuck wall angle $\theta_2$. Further, the unit depth between an uppermost portion of a circular end wall and a lowermost portion of a countersink is between about 0.215 and 0.225 inches.

Thus, in one aspect of the present invention, a metallic beverage can end is provided which comprises:

a circular end wall adapted for interconnection to a side wall of a beverage can;

an upper chuck wall interconnected to said circular end wall and extending downwardly at an upper chuck wall angle $\theta_1$ of between about 25–35 degrees as measured from a vertical plane;

a lower chuck wall integrally interconnected to said upper chuck wall and extending downwardly at an upper chuck wall angle of between about 18–32 degrees as measured from a vertical plane.

a countersink interconnected to a lower portion of said lower chuck wall and a lower portion of an inner panel wall and having a radius of curvature less than about 0.015 inches;

said inner panel wall extending upwardly at an angle $\phi_1$ of between about 0 and 8 degrees from a substantially vertical plane; and a central panel interconnected to an upper end of said inner panel wall and raised above said countersink.

DETAILED DESCRIPTION

Figure 1:
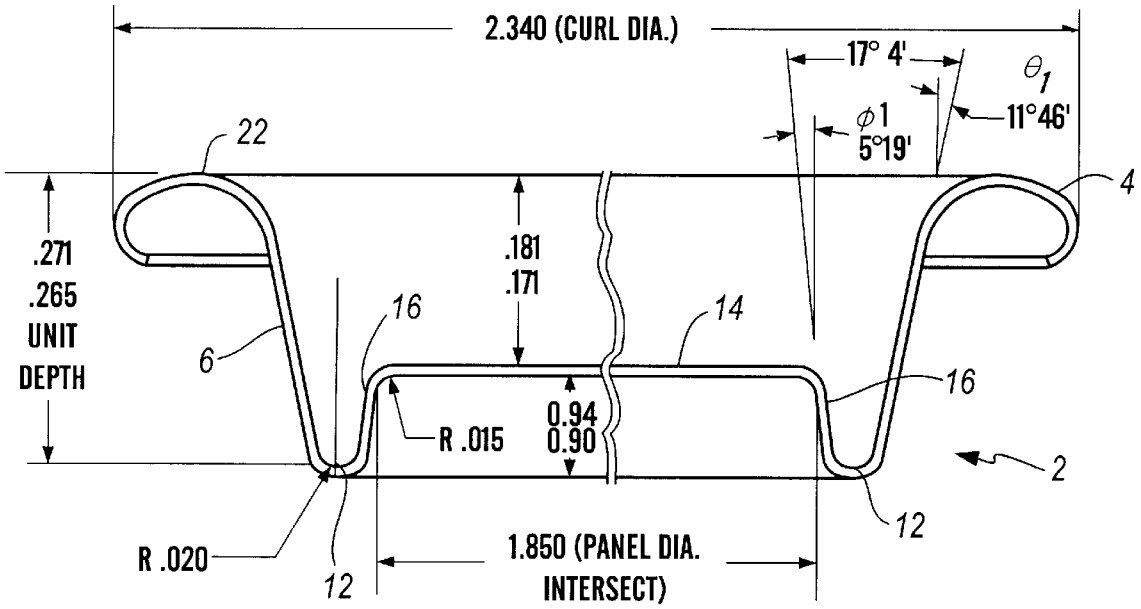
FIG. 1 is a cross sectional view of a conventional 202 shell can end.

Referring now to the FIGS. 1–17, cross sectional front elevation views are provided of numerous embodiments of the present invention. More specifically, a typical metallic beverage can end 2 is described which is generally comprised of a circular end wall 4, a chuck wall 6, a countersink 12, a central panel 14, and an inner panel wall 16 which interconnects the central panel 14 to the countersink 12. The chuck wall 6 may additionally be comprised of an upper chuck wall 8 and lower chuck wall 10. In some embodiments, the inner panel wall 16 may additionally be comprised of an inner panel wall upper end 18 and an inner panel wall lower end 20. Further, the top portion of the circular end wall 4 is defined by what's typically referred to in the beverage can art as a crown 22.

The chuck wall angle $\theta_1$ is defined herein as the angle diverging from a vertical plane as it extends downwardly toward a countersink 12. In various embodiments, there may be an additional chuck wall angle $\theta_2$, which is defined as the divergence from an imaginary vertical plane of the lower chuck wall 10. Thus, in some embodiments of the present invention there exists both an upper chuck wall 8, a lower chuck wall 10 and a corresponding upper chuck wall angle $\theta_1$ and a lower chuck wall angle $\theta_2$. Additionally, an inner panel wall 16 is typically oriented at an angle $\phi_1$ which is shown in the drawings, and further represents an angle extending from an imaginary vertical plane. In some embodiments, a lower inner panel wall angle $\phi_2$ may be additionally seen which is a divergence from angle $\phi_1$, and which defines the angle of the inner panel wall upper end 18 as measured from an imaginary vertical plane.

Referring now to FIG. 1, a cross sectional view is provided which generally illustrates a prior art conventional can end. As seen in this particular drawing, the angle of the chuck wall is preferably between about 11 and 15 degrees, the inner panel wall preferably between about 0 and 6 degrees, and the radius of curvature of the countersink less than or about 0.020 inches. Further, the central panel has a depth of between about 0.171 and 0.181 inches from crown 22.

Figure 2:
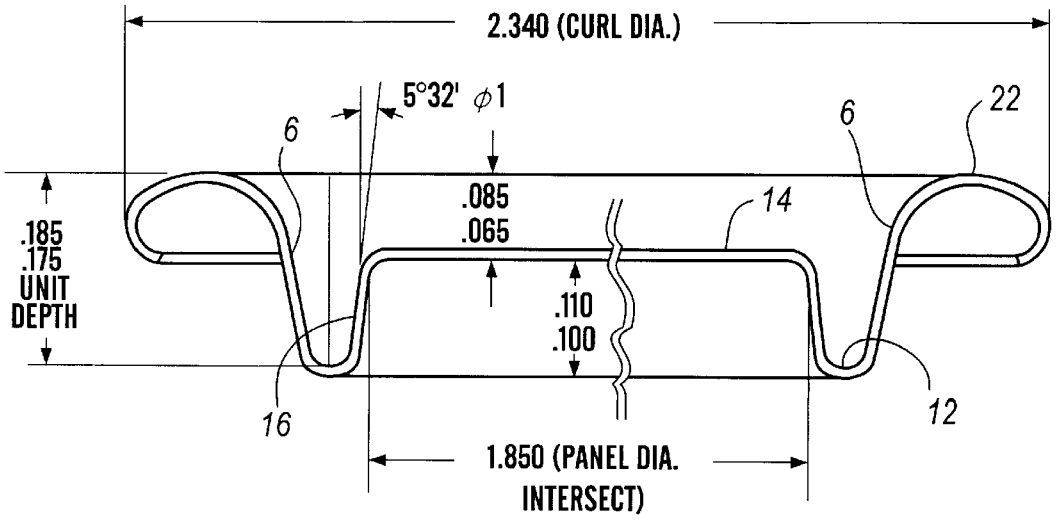
FIG. 2 is a cross sectional view of a conventional 202 pre-shell showing the can end prior to a final forming to produce a final shell as that described in FIG. 3.
Figure 3:
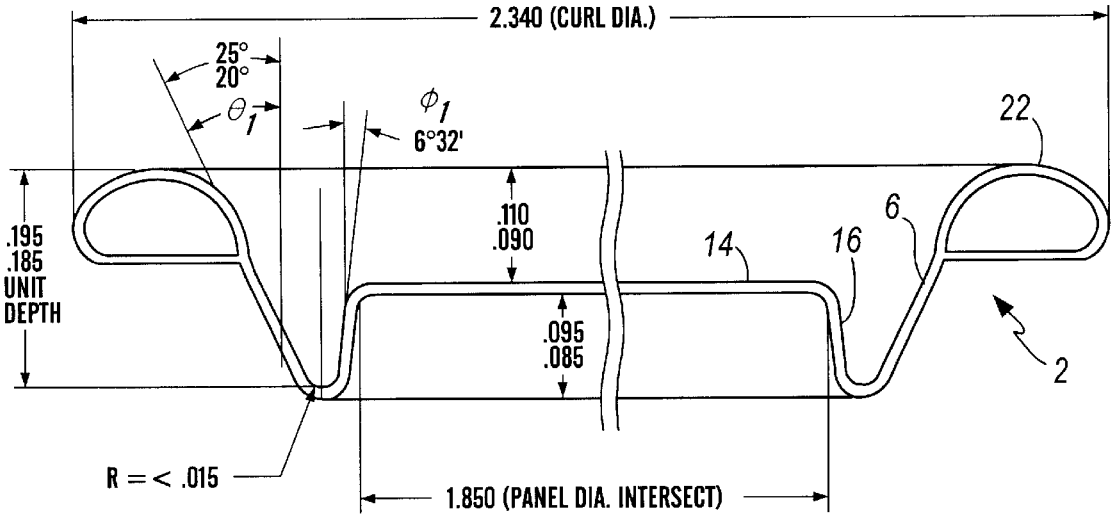
FIG. 3 is a cross sectional view of one embodiment of the present invention.

Referring now to FIG. 2, a pre-shell of a 202 beverage can end is shown which illustrates the dimensions of a "pre-shell" can end prior to being reformed into the embodiment shown in FIG. 3. As seen in FIG. 3, in one embodiment of the present invention the chuck wall 6 has an angle $\theta_1$ between about 20 and 25°, while the inner panel wall 16 is positioned at an angle of about 6° 32'. The interconnection of the chuck wall 6 and the inner panel 16 defines a countersink 12 which preferably has a radius of less than about 0.15 inches. Based on this geometric configuration, the central panel 14 has a depth of between about 0.090 to 0.110 inches from the height of the crown 22, or about 0.085 to 0.095 inches from the lowermost depth of the countersink 12. Further, in this embodiment the central panel 14 has a diameter of 1.850 inches.

Figure 3A:
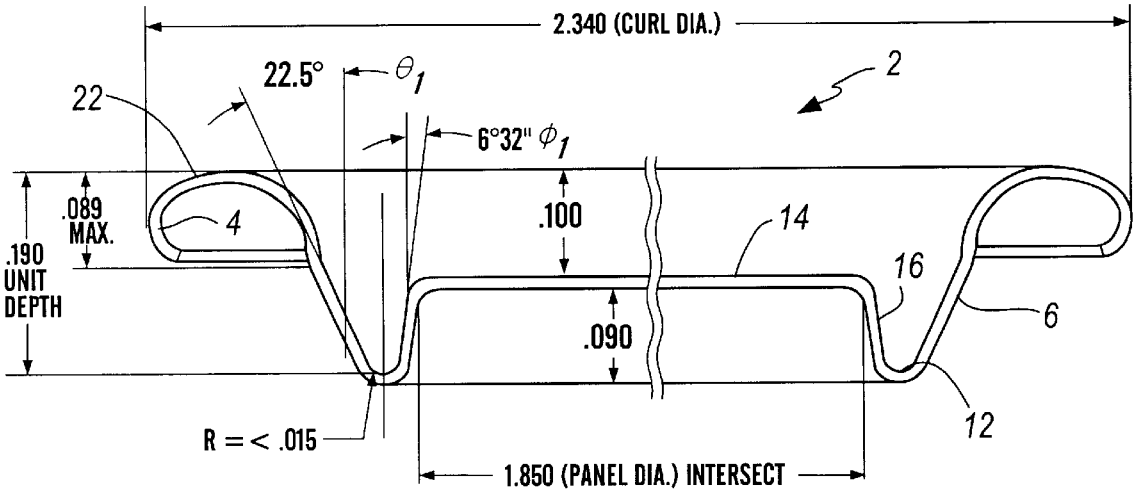
FIG. 3A is a cross sectional view of an embodiment of the invention shown in FIG. 3.

Referring now to FIG. 3A, an embodiment of FIG. 3 is provided herein with exact dimensions as opposed to the geometric ranges provided in FIG. 3. As depicted, the chuck wall has an angle $\theta_1$ of 22.5°, while the inner panel wall 16 is oriented at an angle $\phi_1$ of about 6° 32' from an imaginary vertical plane. These two angles converge at the countersink 12, which has a radius of less than about 0.15 inches. In this configuration, the central panel 14 has a depth of about 0.100 inches from crown 22, or about 0.090 inches from the lowermost portion of the countersink 12. As further shown, the central panel 14 has a diameter of 1.850 inches, and the countersink 12 has a total depth of 0.190 inches from the crown 22. In this embodiment, a material savings, i.e. blank reduction of 8.9%–10.7% is realized from the geometric configuration of a typical beverage can end.

Figure 4:
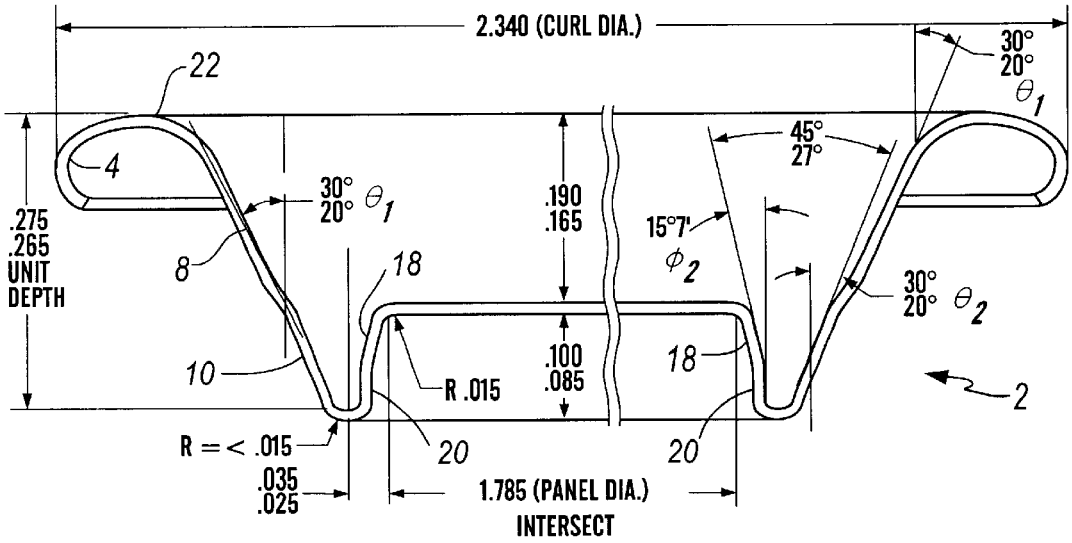
FIG. 4 is a cross sectional view of an alternate embodiment of the present invention.

Referring now to FIG. 4, an alternative embodiment of the present invention is provided which has been shown to provide a blank reduction of materials from a conventional can end of about 4.5%, with an average internal pressure buckle resistance of about 112 psi. More specifically, the chuck wall 6 has an upper chuck wall portion 8, and a lower chuck wall portion 10 which are distinct. More specifically, the upper chuck wall 8 has an angle $\theta_1$ between about 20° and 30°, while the lower chuck wall 10 has an angle $\theta_2$ of between about 20–30° as shown. Additionally, the inner panel wall 16 has a slight bend wherein the lower end 20 of the inner panel wall is substantially vertical while the upper end 18 oriented is at an angle between about 7° and 15°. Additionally, the countersink 12 has a radius of less than 0.015 inches, while the central panel 14 is about 0.165 to 0.190 inches from crown, or about 0.085 to 0.100 inches from the bottom of the countersink 12. As further seen in FIG. 4, the overall unit depth from crown 22 to the bottom of the countersink 12 is between about 0.265 to 0.275 inches.

Figure 4A:
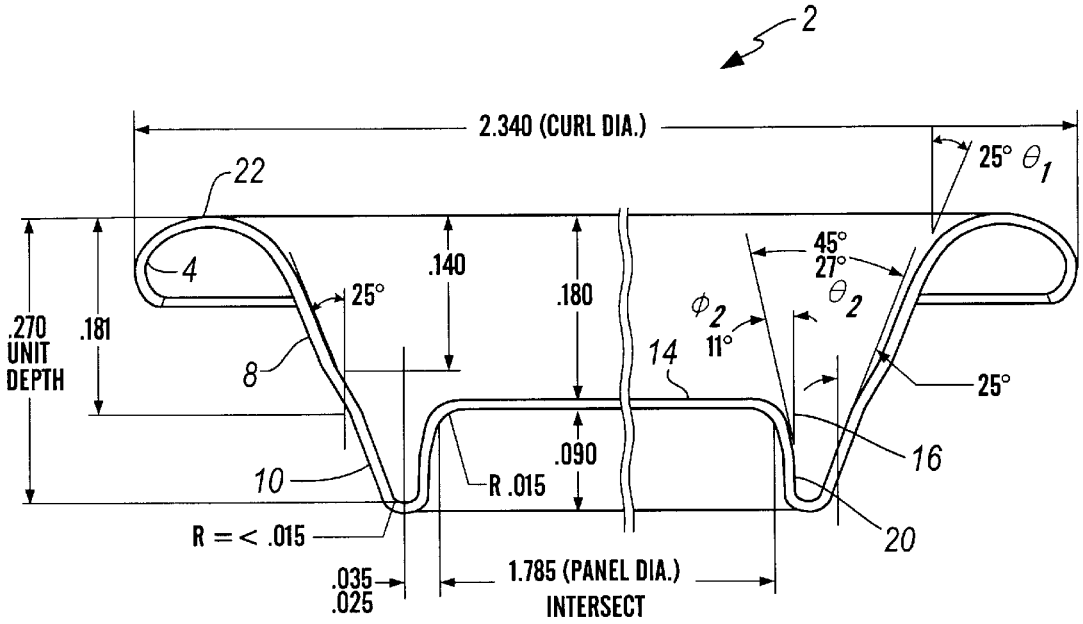
FIG. 4A is a cross sectional view of a preferred embodiment of the invention shown in FIG. 4.
Figure 5:
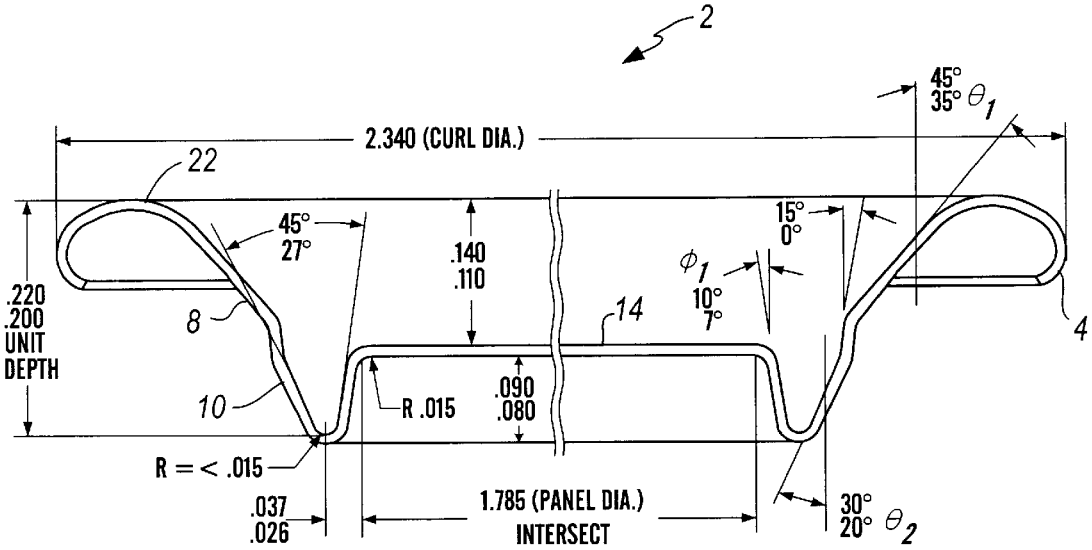
FIG. 5 is a cross sectional view of an alternate embodiment of the present invention.
Figure 6:
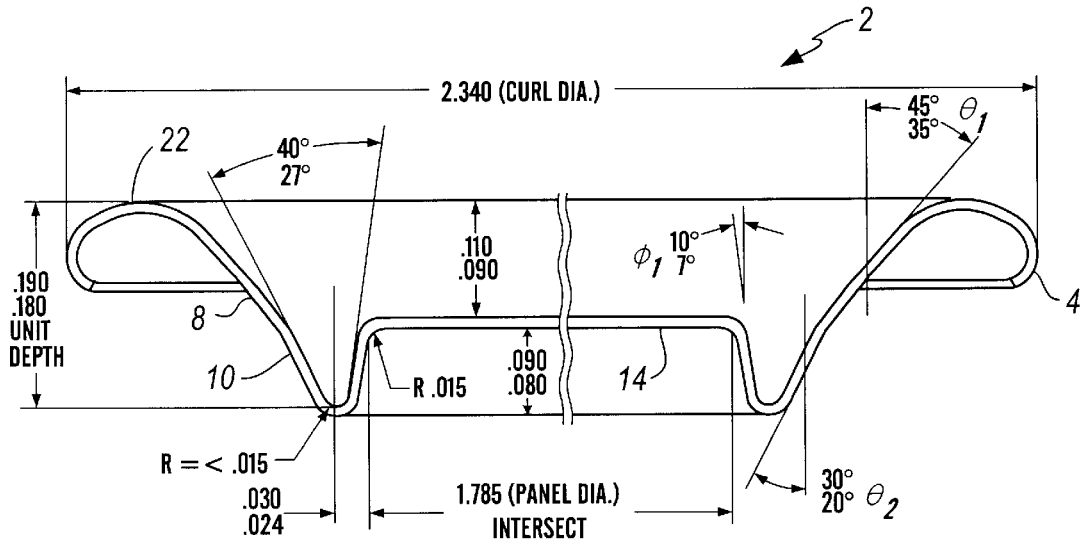
FIG. 6 is a cross sectional view of an alternative embodiment of the present invention.
Figure 7:
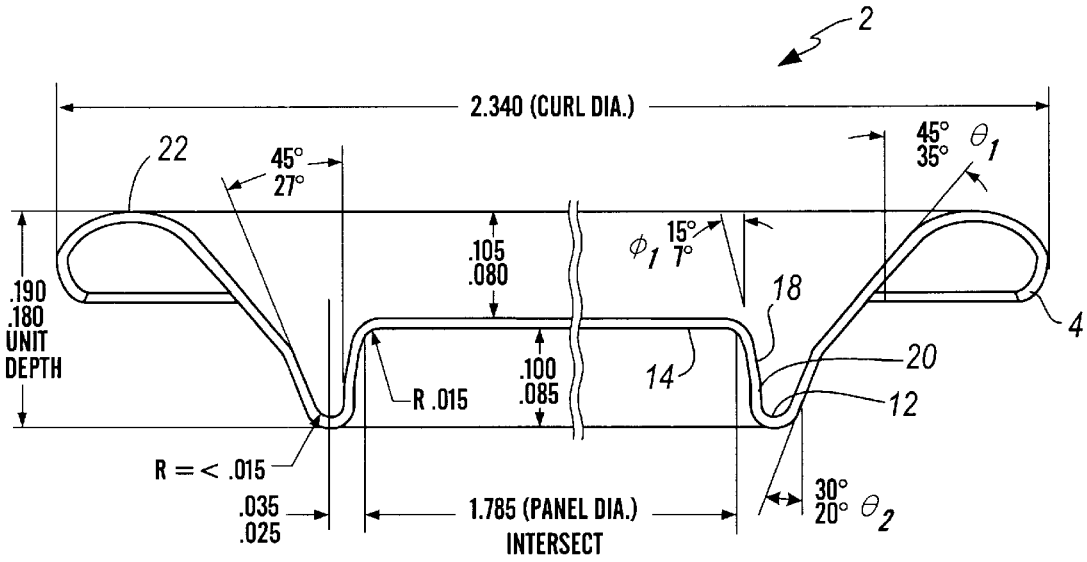
FIG. 7 is a cross sectional view of an alternative embodiment of the present invention.

Referring now to FIG. 4A, an embodiment of the invention shown in FIG. 4 is provided with actual dimensions as opposed to preferred ranges. More specifically, the chuck wall 6 is comprised of an upper chuck wall 8 and lower chuck wall 10. In this particular embodiment, the upper chuck wall has an angle $\theta_1$ of 25°, while the lower chuck wall additionally has an angle of about 25°. The bend in the chuck wall is utilized to enhance the overall strength of the can end. The upper chuck wall 8 diverges into the lower chuck wall at a height of about 0.140 inches from crown 22, and with a lower bend of about 0.181 inches from crown 22. The inner panel wall 16 is substantially vertical on a lower end 20 and has an upper end angle $\phi_2$ of about 11°. The countersink 12 defined between the inner 20 panel wall 16 and the chuck wall 6 is less than about 0.015 inches. Further, in this particular embodiment, the central panel 14 has a diameter of about 1.785 inches.

FIGS. 5–8 represent additional embodiments of the present invention and identify various chuck wall angles $\theta_1$ and $\theta_2$, inner panel wall angles $\phi_1$ and $\phi_2$, and the dimension of the central panel 14 as these various angles change in different embodiments. However, the countersink radius is less than about 0.015 inches in each of these particular embodiments.

Figure 9:
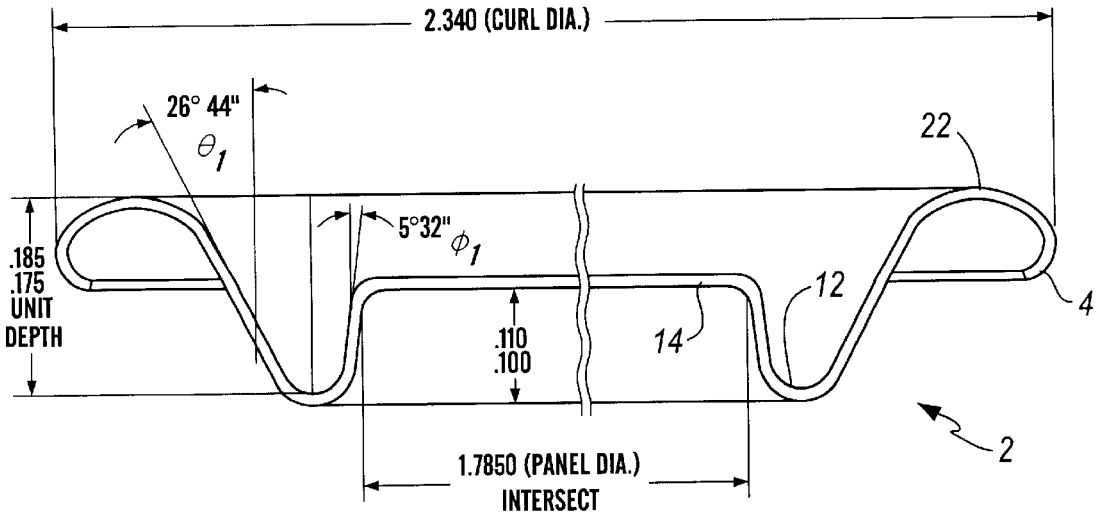
FIG. 9 is a cross sectional view of a conventional 202 pre-shell showing the can end prior to a final forming to produce a final shell as that described in FIG. 10.
Figure 10:
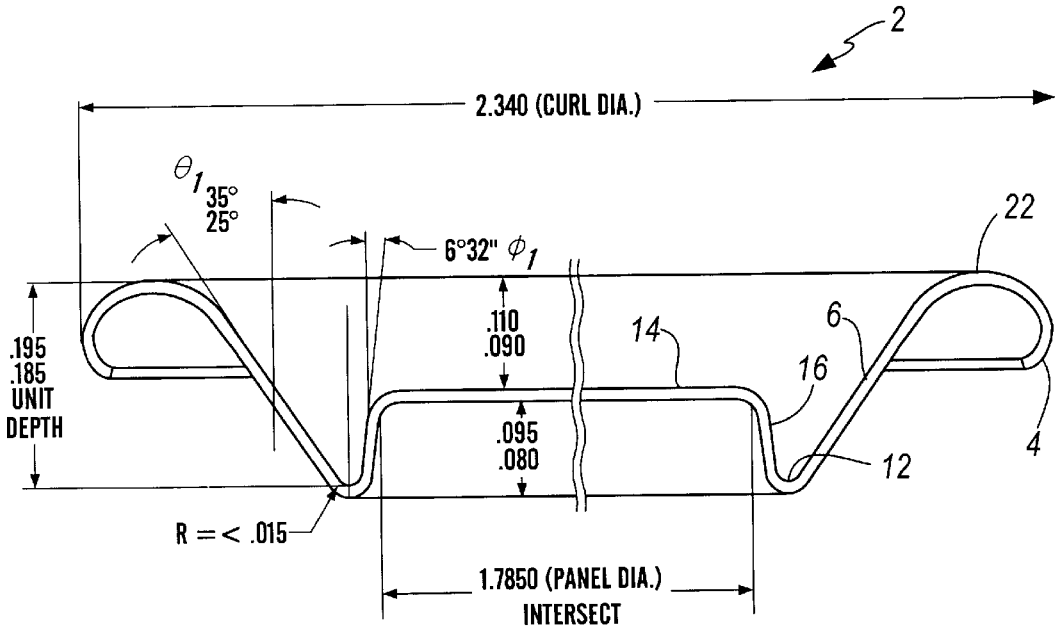
FIG. 10 is a cross sectional view of an alternative embodiment of the present invention which is reformed from the pre-shell identified in FIG. 9.

Referring now to FIG. 9, a cross sectional view of a pre-shell of a 202 beverage can is shown prior to being reformed to manufacture the beverage can end 2 shown in FIG. 10.

FIG. 10 represents a cross-sectional view of an alternative embodiment of the present invention and illustrates a chuck wall 6 having an angle $\theta_1$ between about 25° and 35°, a inner panel wall 16 having an angle $\phi_1$ of about 6° 32', and a countersink 12 positioned therebetween having a radius of less than about 0.015 inches. In this particular embodiment, the chuck wall 6 is substantially linear, and the central panel 14 has a depth of between about 0.090 and 0.110 inches from crown 22 and a height from the countersink depth of between about 0.085 to 0.095 inches. Additionally, the central panel 14 has a diameter of 1.785 inches. In this particular embodiment the material blank reduction is estimated to be between 11.7% and 13%, as compared to a conventional 202 beverage can end as shown in FIG. 1.

Figure 11:
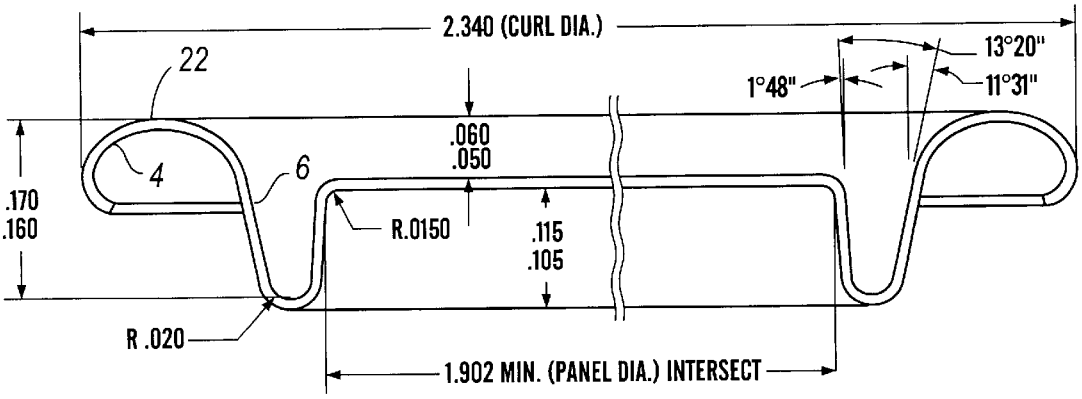
FIG. 11 is a cross sectional view of a conventional 202 pre-shell showing the can end prior to a final forming to produce a final shell as that described in FIG. 11B.
Figure 11B:
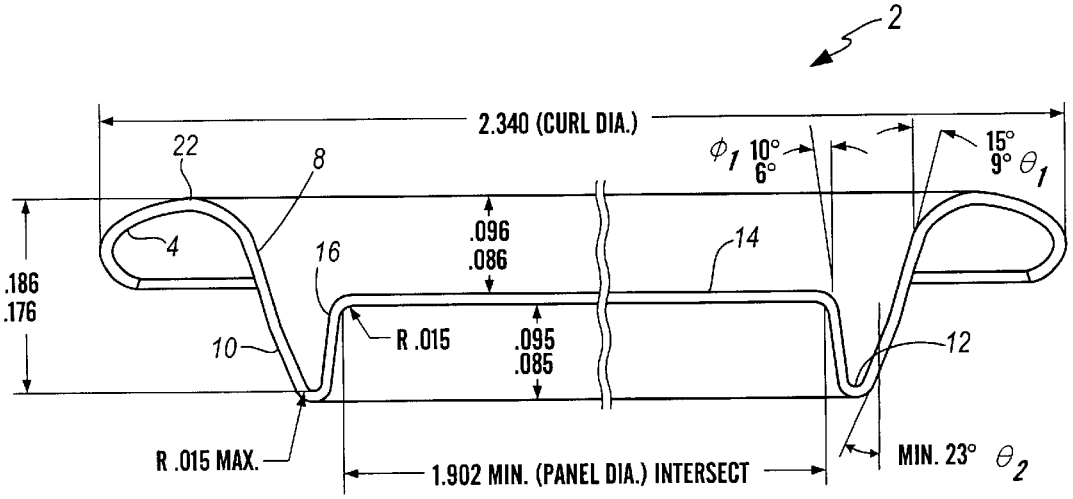
FIG. 11B is a cross sectional view of an alternative embodiment of the present invention.

FIG. 11 is a cross sectional view of a pre-shelled 202 can end which is then used in conjunction with a conversion press or other similar manufacturing method for conversion to the beverage can end shown in FIG. 11B. As seen in FIG. 11B, in one embodiment of the present invention provided herein, the beverage can end 2 has a chuck wall upper angle $\theta_1$ of between 8° and 15°, and a lower chuck wall angle $\theta_2$ of a minimum of 23°. The inner panel wall 16 additionally has an angle of between about 6° and 10°, while the countersink 12 has a radius of less than 0.015 inches. In this particular embodiment, the lower most portion of the countersink 12 is between about 0.176 to 0.186 inches from crown 22, while the central panel 14 has a depth of between about 0.086 to 0.096 inches from crown. In this particular embodiment, the average internal buckle strength is believed to be greater than 100 psi, with a potential material reduction of at least about 7%.

Figure 12:
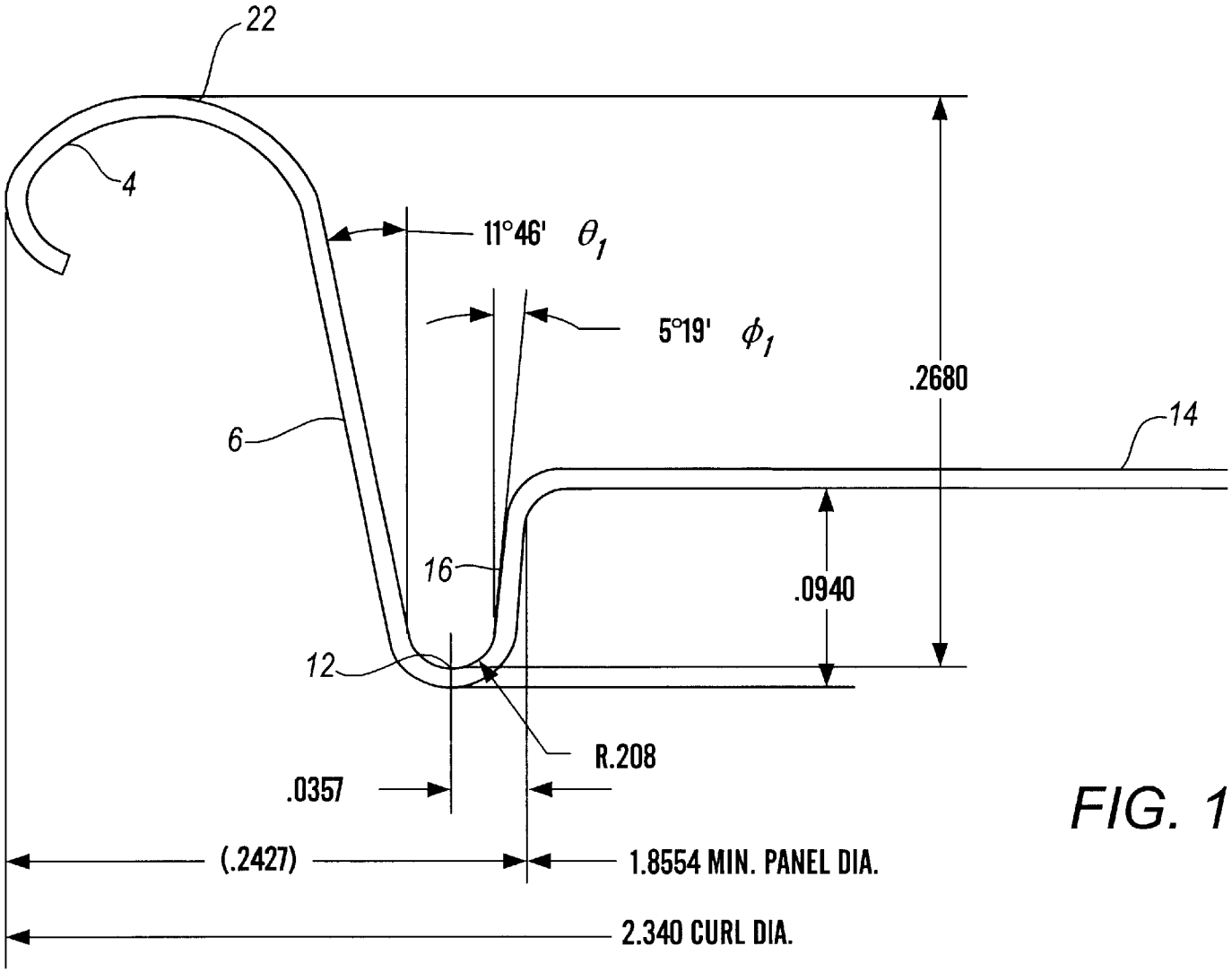
FIG. 12 is a digitized image of a cross section showing the actual dimensions of the embodiment shown in the conventional can end illustrated in FIG. 1.
Figure 13:
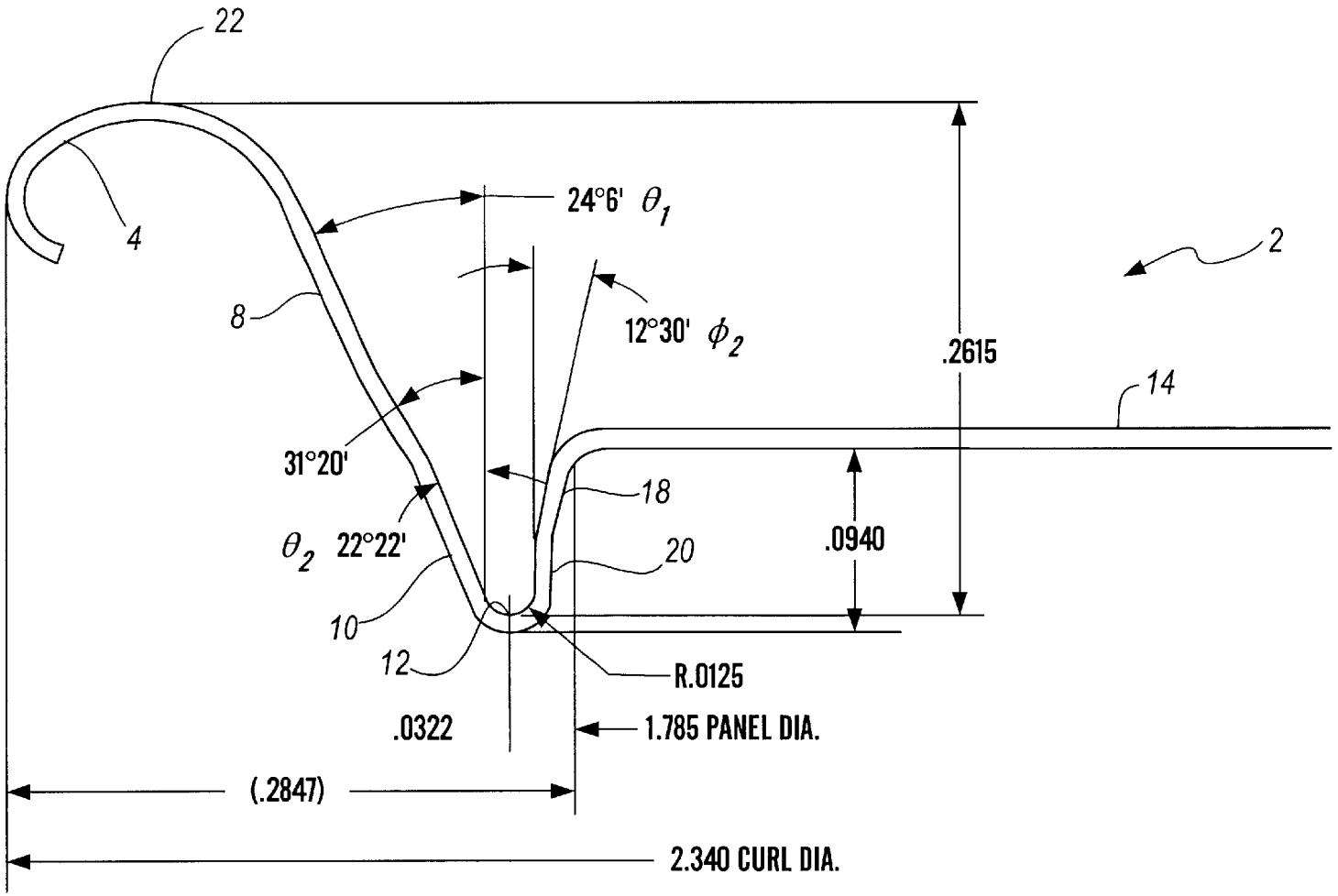
FIG. 13 is a digitized image of a cross section showing the actual dimensions of the embodiment shown in FIG. 4.
Figure 14:
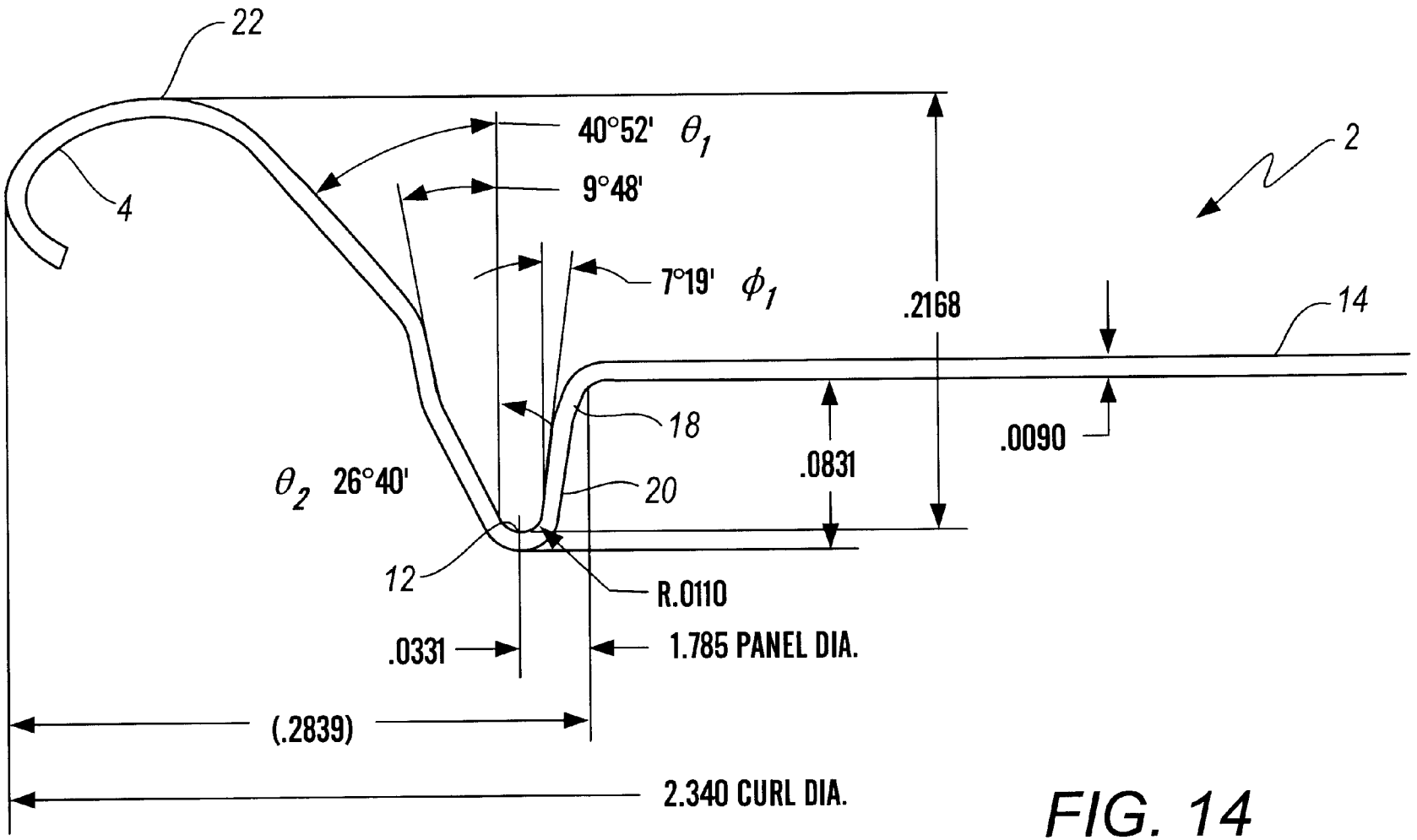
FIG. 14 is a digitized image of a cross section showing the actual dimensions of the embodiment shown in FIG. 5.
Figure 15:
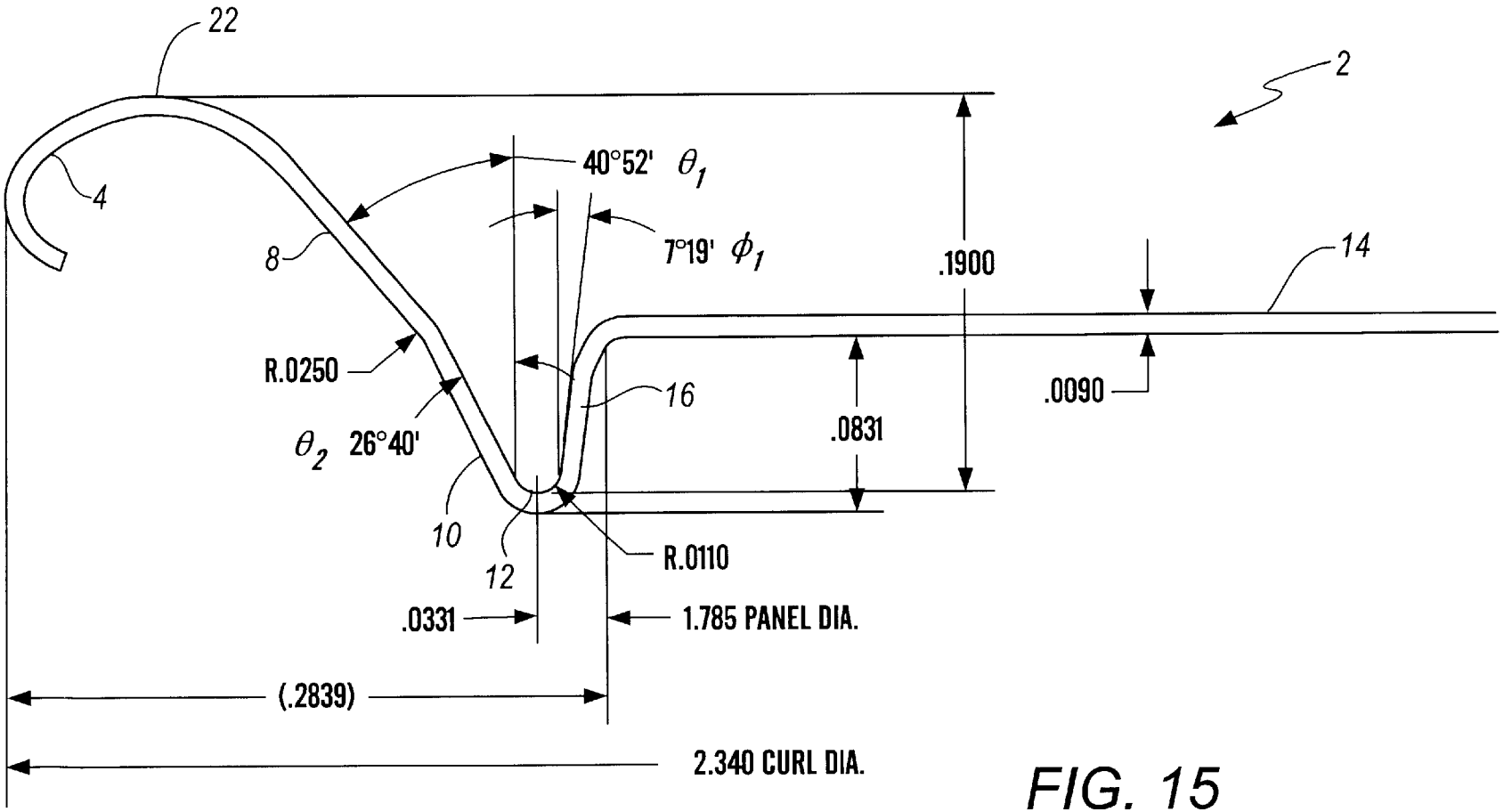
FIG. 15 is a digitized image of a cross section of the actual dimensions of the embodiment shown in FIG. 6.
Figure 16:
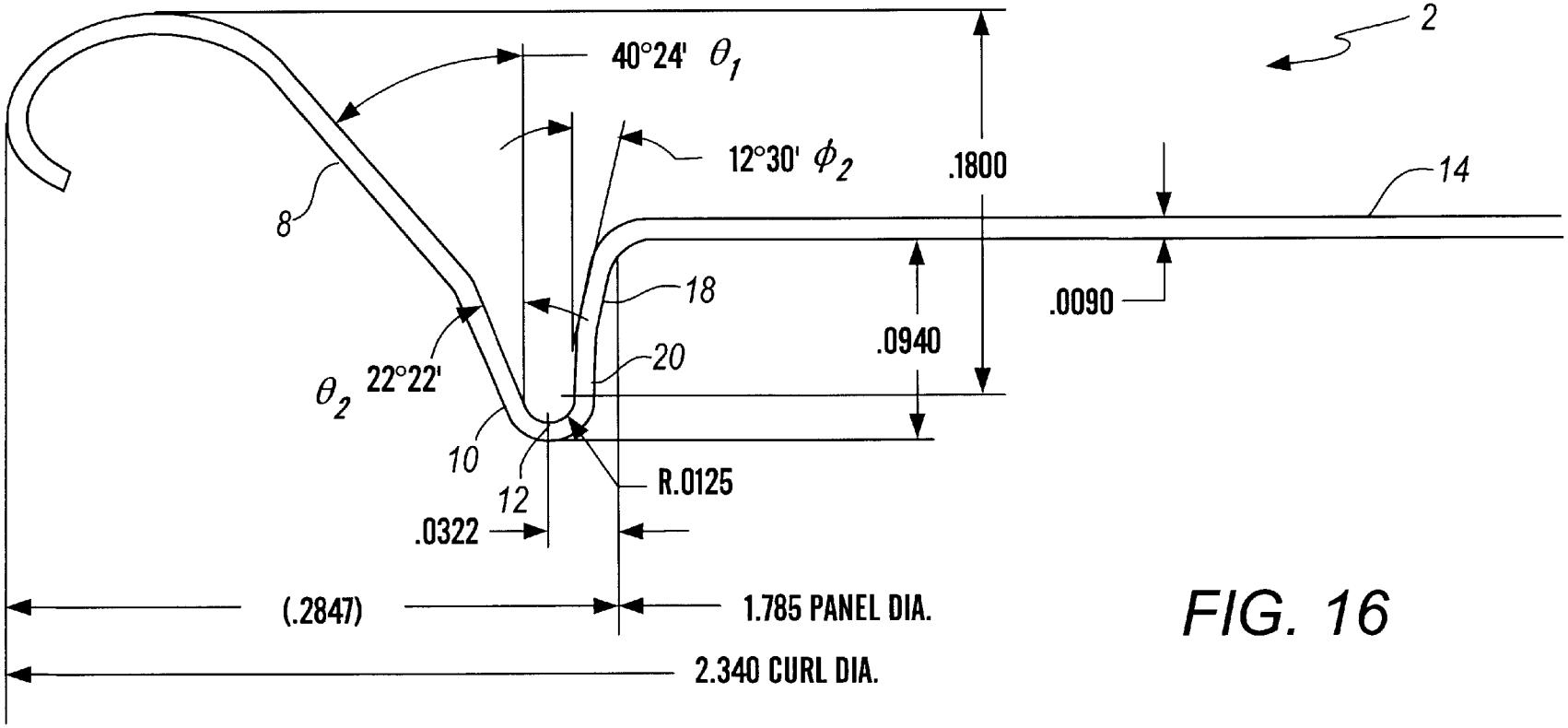
FIG. 16 is a digitized image of a cross section of the actual dimensions of the embodiment shown in FIG. 7.

Referring now to FIGS. 12–17, digitized images of cross sections for various embodiments shown in FIGS. 1–10 are provided herein to provide additional detail to the size and dimensions of the particular beverage can end 2. More specifically, FIG. 12 is a digitized image of FIG. 1 showing a typical conventional 202 beverage can shell. FIG. 13 is a digitized image of the embodiment shown in FIG. 4, while FIG. 14 is a digitized image of the embodiment shown in FIG. 5. Moreover, FIG. 15 is a digitized image of the embodiment shown in FIG. 6, while FIG. 16 is a digitized image of the beverage can end 2 shown in FIG. 7.

Figure 8:
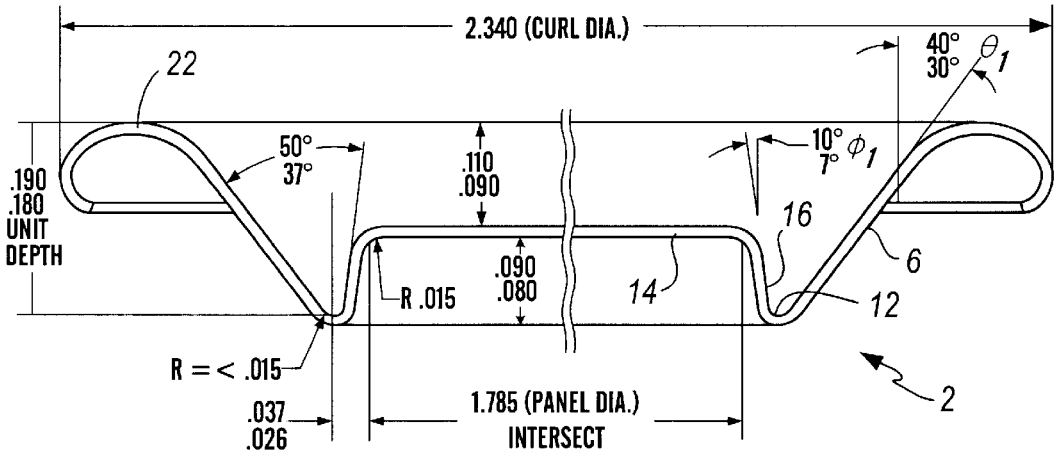
FIG. 8 is a cross sectional view of an alternative embodiment of the present invention.
Figure 17:
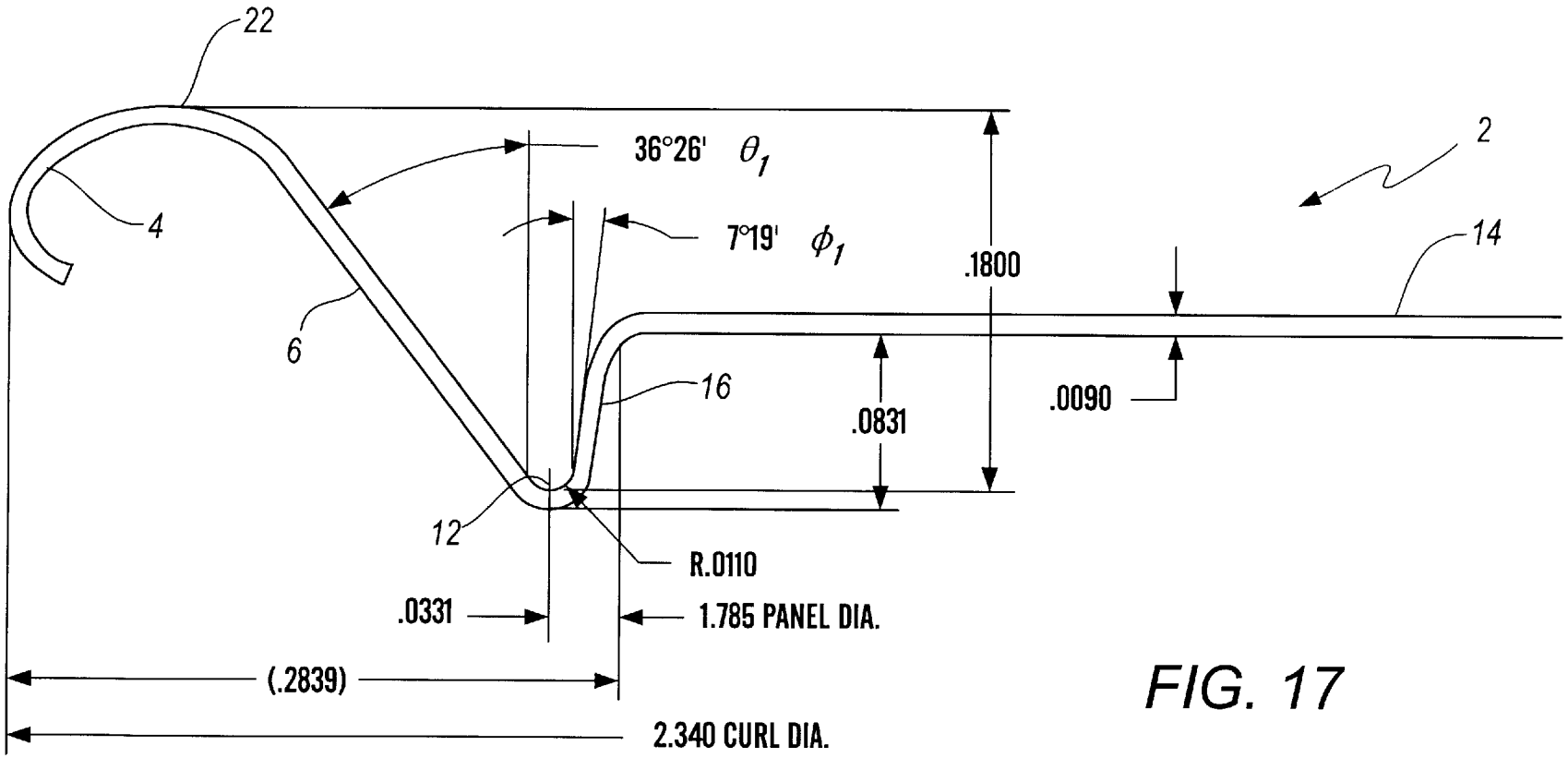
FIG. 17 is a digitized image of a cross section of the actual dimensions of the embodiment shown in FIG. 8.
Figure 18:
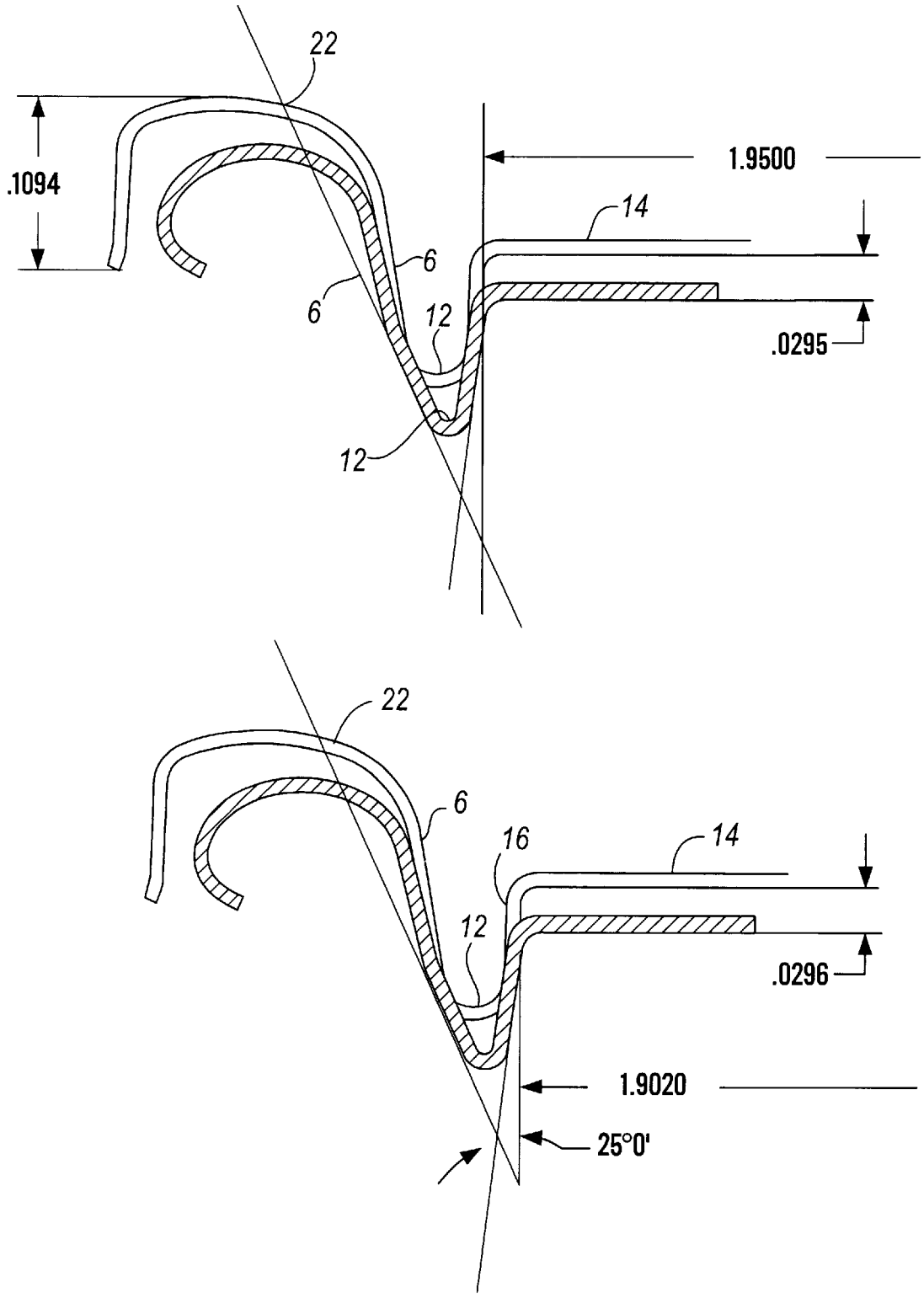
FIG. 18 is a cross-section of a beverage can end of the present invention and showing the finished beverage can end transposed over the pre-shell.

FIG. 17 is a digitized image of the embodiment shown in FIG. 8, and identifying a beverage can end with a chuck wall having an angle $\theta_1$ of 36° 26', an inner panel wall 16 having an angle $\phi_1$ of 7° 19 minutes, and a radius of curvature at the countersink of 0.011 inches. In this particular embodiment, the countersink has a depth of 0.180 inches from crown 22, while the center panel 14 has a height of 0.0831 inches from the bottom of the countersink 12. FIG. 18 depicts one embodiment of the present invention and shows a finished can end transposed over the pre-shell to show the variations in the geometric shape.

Figure 19:
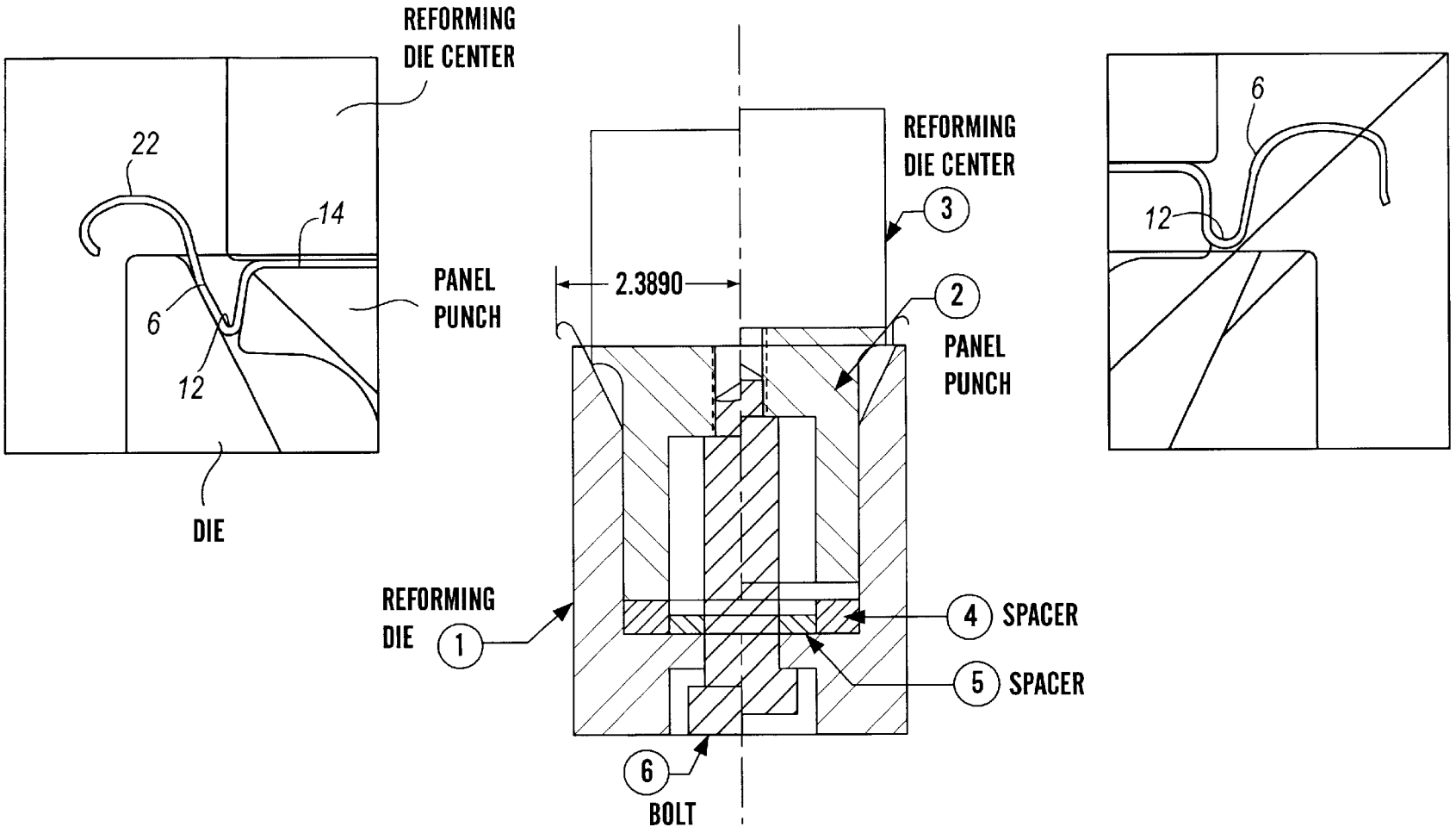
FIG. 19 is a cross-sectional front elevation showing the machinery used to convert the pre-shell to the beverage can end, and identifying the pre-shell in a position prior to conversion.

One objective of the present invention is to provide an aggressive countersink 12 with greater resistance to deformation, while minimizing metal thinning or stretching and damage to the interior coating. This process is accomplished by free forming the panel 14 and countersink 12 without the assistance of both a male and female tool combination, as seen in FIG. 19. Stated otherwise, the completed beverage can end is reformed from the pre-shell without utilizing a punch driven into the countersink area.

Within the process, the countersink 12 is placed in compression with forces against the inner panel wall 16, while rolling a tight lower radius adjacent to the inner panel wall 16. This method provides a controllable wall, wall angle, and geometry as desired, and a tighter than conventional lower countersink radius. This is all accomplished with acceptable material thinning and coating disturbance.

There are two approaches to the process described herein. Fist, the pre-shell Conversion combination illustrated in figure combinations 2/3, 2/3A, 9/10 and 11/11B, where FIGS. 2, 9 and 11 depict the pre-shell dimensions prior to converting the can end to the finished product shown in FIGS. 3, 3A, 10 and 11B.

In general, the pre-shell contains a larger countersink radii, shallow unit or countersink depth, and central panel with a greater depth than conventional can ends. The pre-shell is then captured between two tools on the center panel. This is a clamping function prior to performing the operation which places the countersink in compression. The tool positioned on the underside of the shell contains the desired panel diameter, panel radius, wall taper and other preferred can geometry as necessary.

The pre-shell is then pushed into the reforming tool forcing the countersink area against the panel tool and rolling up the panel wall, thus taking the panel tool shape and wrapping the lower radius tight against the panel tool. The reforming tool contains the desired outer chuck wall geometry, and allows the creation of a can end with a preferred geometry without requiring a punch to be driven into the countersink 12 area.

These sequences can also be achieved in a shell press, requiring no further forming to achieve final countersink form geometry. The results from this process are illustrated in FIGS. 4, 4A, 5, 6, 7 and 8, but not limited only to these embodiments.

The process includes a round upper tool larger in diameter than the panel, with a flat face and a large outer radius to avoid material thinning. The tool forms a cup substantially deeper than the desired final unit or countersink depth. The material within the cup must be adequate to provide material for the panel and countersink features.

As the upper tool begins to move upward, a tool that contains the panel diameter, panel radius, panel wall or desired wall geometry, and outer chuck wall shape moves upward as well. The material drawn in the cup is now formed and compressed to the desired central panel and countersink shape.

Figure 20:
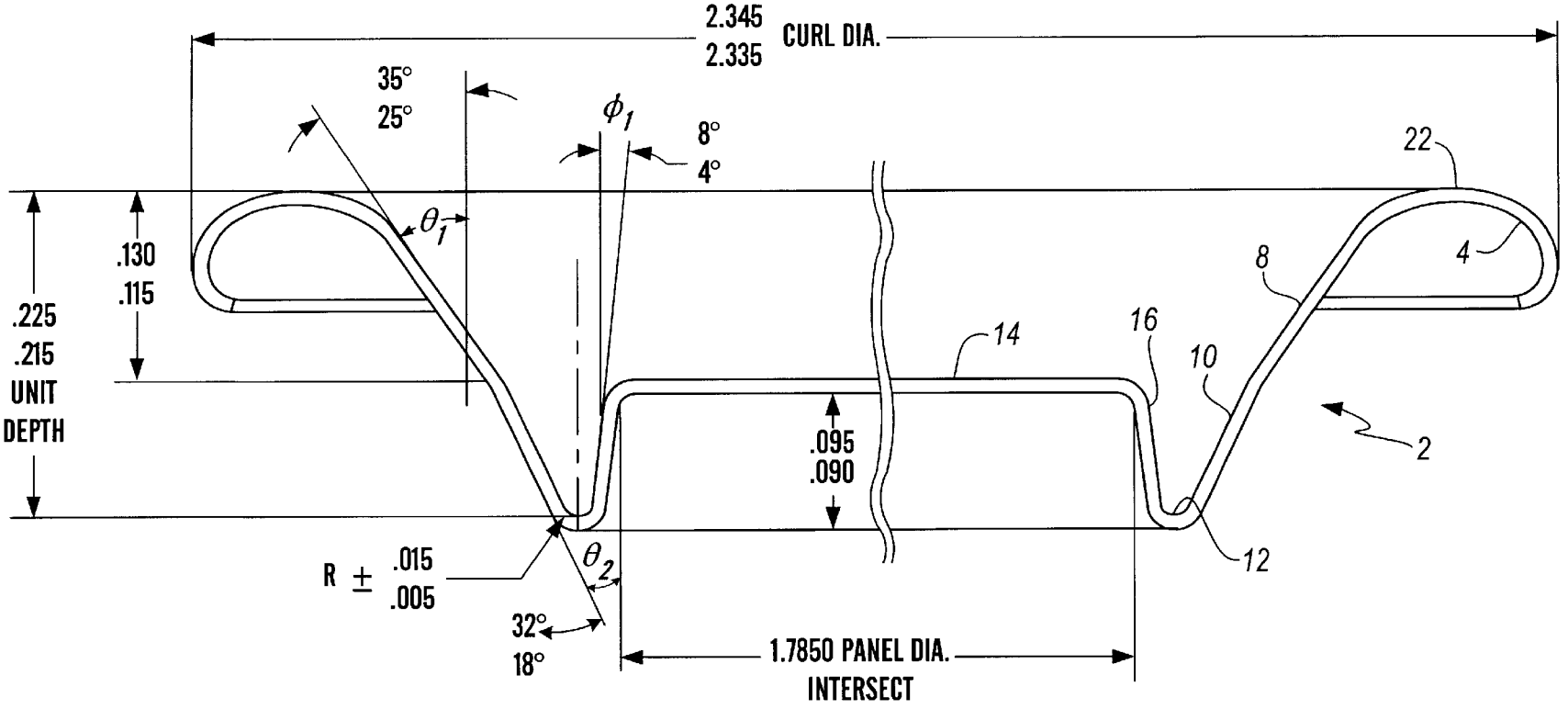
FIG. 20 is a cross-section of one embodiment of a can end.

Referring now to FIG. 20, one additional embodiment of the present invention is provided herein. In this design, a metallic beverage can end is provided which comprises a circular end wall 4, an upper chuck wall 8, lower chuck wall 10, inner panel wall 16 and a countersink 12 positioned between the lower chuck wall 10 and inner panel wall 16. A central panel 14 is interconnected to an upper portion of the inner panel wall 16 and forms an interior portion of the beverage can end 2.

More specifically, the beverage can end of FIG. 20 has an upper chuck wall 8 extending downward and inwardly at an upper chuck wall angle $\theta_1$ of between about 25–35 degrees, and more preferably 30 degrees interconnected to the upper chuck wall 8 is a lower chuck wall 10, which further extends downward and inwardly at a lower chuck wall angle $\theta_2$ of between about 18–32 degrees, and more likely 25 degrees.

A countersink 12 is interconnected to the lower chuck wall 10 and has a radius of between about 0.005–0.15 inches, and preferably 0.010 inches. Extending upwardly from the countersink 12 is an inner panel wall 16 which is inclined in some embodiments at an inner panel wall angle of $\theta_1$ of between about 4–8 degrees, and more typically 6 degrees. The upper chuck wall angle $\theta_1$, lower chuck wall angle $\theta_2$ and inner panel wall angle $\phi_1$ are all measured with respect to an imaginary vertical plane which is oriented at substantially right angles to the central panel 14.

A center panel 14 is integrally interconnected to an upper portion of the inner panel wall 16 and is elevated between about 0.090–0.095 inches above a lowermost portion of the countersink 12. The countersink 12 is further positioned from an upper portion of the circular end wall 4 at a unit depth of between about 0.215–0.225 inches. Further, the upper chuck wall 8 diverges to the lower chuck wall 10 at a depth of between about 0.115–0.130 inches from an upper-most portion of the circular end wall 20 as seen in FIG. 20.

FIG. 20 depicts a cross-sectional view of one embodiment of a beverage can end 2 and identifying more typical dimensions as opposed to the various ranges provided in FIG. 20. As seen however, this embodiment utilizes an upper chuck wall 8, lower chuck wall 10 and a corresponding upper chuck wall angle $\theta_1$ and lower chuck wall angle $\theta_2$. Further, the unit depth from the crown 22 to a lowermost portion of the countersink 12 is at least about 0.215 inches.

Figure 21:
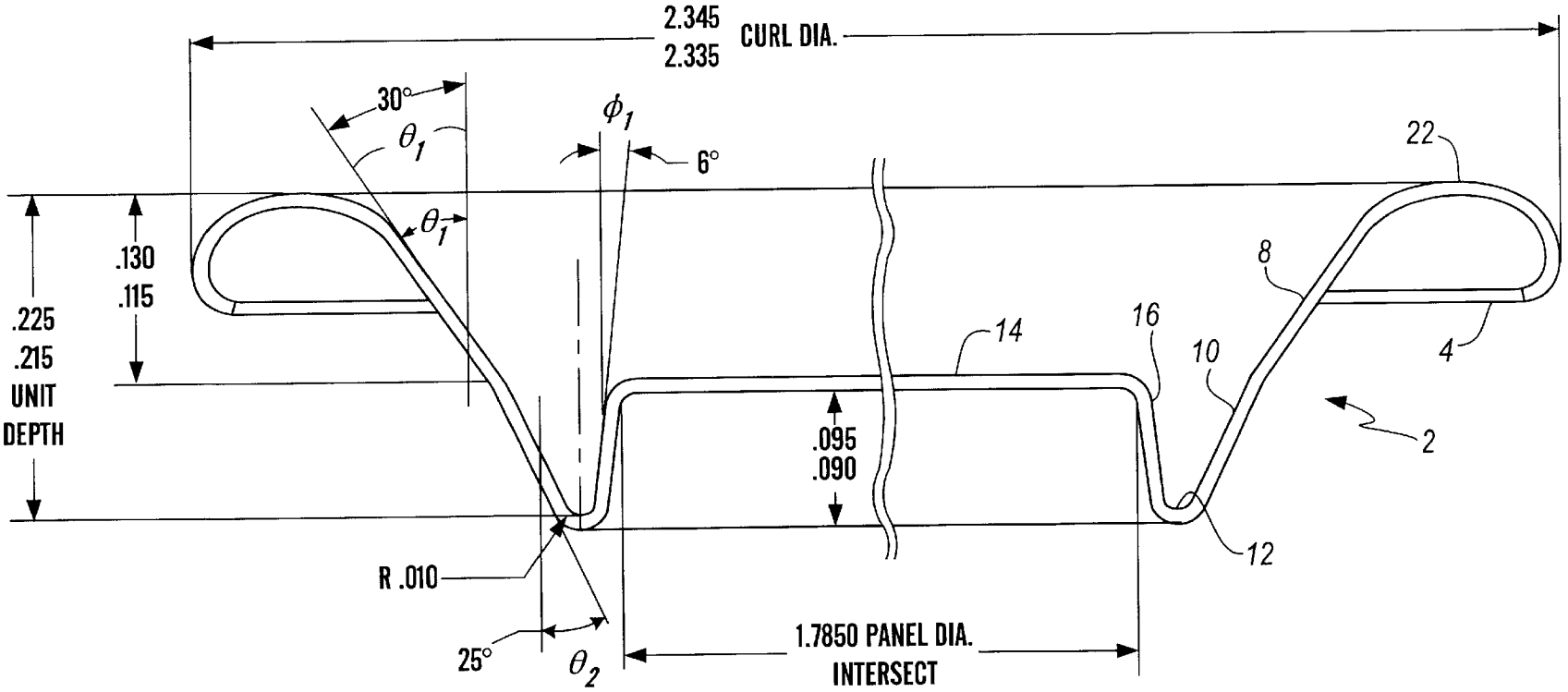
FIG. 21 is a cross-section of one embodiment of the can end described and shown in FIG. 20.

Based on test data, the can ends shown in FIG. 20 and FIG. 21 have achieved average internal buckle resistance of up to 106 psi, and have realized blank average material reductions of about 7.6% as compared to typical prior art beverage can ends.

With regard to each of the various embodiments discussed herein, and as identified in FIGS. 1–21, the improved strength characteristics and reduced costs associated with the beverage can ends are obtained based on the geometric configurations, as well as the metallic properties and specific gauge thickness associated therewith. More specifically, the metallic materials are generally comprised of aluminum, and more commonly aluminum alloys such as 5182H19, 5182H481 and 5,182C515, which are commonly known in the art. With regard to the thickness of these aluminum alloys, typically a gauge of between about 0.0080 and 0.0095 are utilized, with greater thicknesses required for larger diameter beverage cans. Thus, a 202 beverage can end may utilize aluminum materials with thicknesses between about 0.0080 and 0.0090 gauge, while a 206 beverage can end may utilize an aluminum alloy material with a thickness between about 0.0085 and 0.0095 gauge. Thus, in one embodiment of the present invention a 5182H19 aluminum alloy material having a thickness of between about 0.0080 and 0.0085 gauge provides significant cost savings and strength in a 202 sized aluminum beverage can end with the geometric properties defined herein.

For clarity, the following list of components and associated numbering found in the drawings are provided herein:

| No. | Components |
|---|---|
| 2 | Beverage can end |
| 4 | Circular end wall |
| 6 | Chuck wall |
| 8 | Upper chuck wall |
| 10 | Lower chuck wall |
| 12 | Countersink |
| 14 | Central panel |
| 16 | Inner panel wall |
| 18 | Inner panel wall upper end |
| 20 | Inner panel wall lower end |
| 22 | Crown |
| $\theta_1$ | Upper Chuck wall angle |
| $\theta_2$ | Lower chuck wall angle |
| $\phi_1$ | Inner panel wall angle |
| $\phi_2$ | Inner panel wall upper end angle |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A metallic beverage can end adapted for interconnection to a beverage can body, comprising:

a circular end wall adapted for interconnection to a side wall of a beverage can;

a chuck wall integrally interconnected to said circular end wall and extending downwardly at an angle $\theta$ of at least about 8 degrees as measured from a vertical plane;

an inner panel wall interconnected to said lower chuck wall and extending upwardly at an angle $\phi$ of between about 0 degrees and 15 degrees as from a measured substantially vertical plane;

a countersink defined by an interconnection of a lower portion of said chuck wall and a lower portion of said inner panel wall and having a radius of curvature less than about 0.015 inches; and a central panel interconnected to an upper end of said inner panel wall and raised above a lowermost portion of said countersink at least about 0.085 inches.

2. The metallic beverage can end of claim 1, wherein said central panel has a depth between about 0.06 and 0.14 inches from an uppermost portion of said circular end wall.

3. The metallic beverage can end of claim 1, wherein an outermost edge of said central panel is positioned between about 0.19 inches and 0.30 inches from an outer-most point of said circular end wall.

4. The metallic beverage can end of claim 1, wherein said beverage can end is constructed of a metallic material having a thickness no greater than 0.0085 gauge.

5. The metallic beverage can end of claim 1, wherein the interconnection of said central panel and said inner panel wall has a radius of curvature no greater than 0.015 inches.

6. The metallic beverage can end of claim 1, wherein said central panel has a diameter no greater than about 1.80 inches.

7. The metallic beverage can end of claim 1, wherein said chuck wall is comprised of an upper chuck wall and a lower chuck wall having two distinct angles.

8. The metallic beverage can end of claim 1, wherein said beverage can end has a curl diameter no greater than about 2.345 inches.

9. The metallic beverage can of claim 1, wherein said metallic beverage can comprises at least one of 5182H19, 5182H481 and 5182C515 aluminum alloys.

10. A metallic beverage can end adapted for interconnection to a beverage can body, comprising:

a circular end wall adapted for interconnection to a side wall of a beverage can;

an upper chuck wall portion integrally interconnected to said circular end wall and extending downwardly at a chuck wall angle $\theta_1$ of at least about 25 degrees as measured from a vertical plane;

a lower chuck wall portion integrally interconnected to said upper chuck wall portion and extending downwardly at a lower chuck wall angle $\theta_2$ of at least about 18 degrees, as measured from a substantially vertical plane;

a countersink integrally interconnected to said lower chuck wall portion on a first end and a lower end of an inner panel wall on a second end, said inner panel wall extending upwardly at an angle $\phi_1$ of at least about 4 degrees; and a central panel interconnected to an upper end of said inner panel wall.

11. The metallic beverage can end of claim 10, wherein said countersink has a radius of less than about 0.015 inches.

12. The beverage can end of claim 10, wherein said central panel is elevated above a lowermost portion of said countersink at least about 0.090 inches.

13. The beverage can end of claim 10, wherein a lowermost portion of said countersink is positioned at least about 0.215 inches from an uppermost portion of said circular end wall.

14. The beverage can end of claim 10, wherein said beverage can end has a curl diameter no greater than about 2.345 inches.

15. The beverage can end of claim 10, wherein said central panel has a diameter no greater than about 1.785 inches.

16. A metallic beverage can end, comprising:

a circular end wall;

an upper chuck wall dependent from an interior of said circular end wall at an upper chuck wall angle $\theta_1$, as measured from a substantially vertical plane;

a lower chuck wall extending downwardly from said upper chuck wall at a lower chuck wall angle $\theta_2$ as measured from a substantially vertical plane;

an outwardly concave countersink extending radially inwards from said lower chuck wall;

a central panel supported by an inner panel wall of the countersink; and wherein the upper chuck wall angle $\theta_1$ is at least about 25 degrees and the lower chuck wall angle $\theta_2$ is at least about 18 degrees, and said outwardly concave countersink has a lowermost portion at least about 0.215 inches from an uppermost portion of said circular end wall.

17. The metallic beverage can end of claim 16, wherein said central panel is elevated above a lowermost portion of said countersink at least about 0.090 inches.

18. The metallic beverage can end of claim 16, wherein said countersink has a radius no greater than about 0.015 inches.

19. The metallic beverage can end of claim 16, wherein said upper chuck wall and said lower chuck wall intersect at a distance of between about 0.115 and 0.130 inches from an uppermost portion of said circular end wall.

20. The metallic beverage can end of claim 16, wherein said central panel has a diameter no greater than about 1.80 inches.

21. The metallic beverage can end of claim 16, wherein said can end is comprised of a metallic material having a thickness between about 0.0080 and 0.0095 gauge.

22. A beverage can end adapted for interconnection to a can body, comprising:

a circular end wall;

an upper chuck wall integral to said circular end wall and extending downwardly at an upper chuck wall angle $\theta_1$ between about 25 and 35 degrees;

a lower chuck wall extending downwardly from said upper chuck wall at a lower chuck wall angle of $\theta_2$ of between about 18 and 32 degrees;

an inner panel wall extending upwardly from a lower portion of said lower chuck wall to define a countersink positioned therebetween having a radius no greater than about 0.015 inches and positioned at least about 0.215 inches from an upper most portion of said circular end wall;

a central panel interconnected to an upper portion of said inner panel wall and elevated above a lowermost portion of said countersink at least about 0.090 inches.

23. The beverage can end of claim 22, wherein said central panel has a diameter no greater than 1.80 inches.

24. The beverage can end of claim 22, wherein said beverage can end is comprised of an aluminum material with a thickness between about 0.0080 and 0.0095 gauge.

25. The beverage can end of claim 22, wherein said metallic beverage can end comprises a metallic material with at least one of 5182H19, 5182H481 and 5182C515 aluminum alloys.

* * * * *